US006289840B1

(12) United States Patent
Hill

(10) Patent No.: US 6,289,840 B1
(45) Date of Patent: Sep. 18, 2001

(54) FLAG 'N' A PAK WATERSPORT SIGNALING DEVICE

(76) Inventor: Dennis L. Hill, 42424 Road. 222, Oakhurst, CA (US) 93644

( * ) Notice: Subject to any disclaimer, the term of this patent is extended or adjusted under 35 U.S.C. 154(b) by 0 days.

(21) Appl. No.: 09/366,826

(22) Filed: Aug. 4, 1999

(51) Int. Cl.[7] ..... B63C 9/20
(52) U.S. Cl. ..... 116/209; 116/173
(58) Field of Search ..... 116/209, 173, 116/174, 175; 441/81, 89; 446/26, 27, 28

(56) References Cited

U.S. PATENT DOCUMENTS

| | | | | |
|---|---|---|---|---|
| 3,213,823 | * | 10/1965 | Levy et al. | 116/203 |
| 3,946,699 | * | 3/1976 | Mirshak | 116/174 |
| 4,035,856 | | 7/1977 | Oberg | 441/89 |
| 4,598,661 | | 7/1986 | Roe | 116/209 |
| 5,606,931 | * | 3/1997 | Rogers | 116/209 |
| 5,651,711 | | 7/1997 | Samano | 441/89 |
| 5,671,480 | | 9/1997 | Krout | 2/102 |
| 5,893,786 | | 4/1999 | Stevens | 441/89 |
| 6,155,197 | * | 12/2000 | Stanley | 116/173 |

* cited by examiner

*Primary Examiner*—Diego Gutierrez
*Assistant Examiner*—R. Alexander Smith

(57) ABSTRACT

A lightweight housing pack containing a flexible mast, a flag and a means to deploy said mast for use with an otherwise conventional life flotation vest. The housing pack will be attached to the back of an existing vest by a fastening means and the actuator positioned at the upper front shoulder. The flexible mast having a highly visible flag signal device attached to the uppermost portion. The flexible mast will be internally contained within a pack by a means of fasteners securing the outer flap to the inner body of the pack. The flexible mast will be released from its housing by pulling on a deployment ring. The pull ring is attached to a sleeved pull cord and terminated at the avulsion closer. When the flexible mast and flag are released they will extend vertically into the air and become highly visible by oncoming vessels.

7 Claims, 4 Drawing Sheets

FLAG 'N' A PAK WATERSPORT SIGNALING DEVICE

BACKGROUND

1. Field of Invention

This invention relates to water sport safety devices specifically to flotation devices and signaling devices worn by a person engaged in water activities. A housing pack mounted on a flotation vest, which has a flexible mast and flag enclosed. Deployment allows increased visibility of a person in water.

2. Description of Prior Art

In my youth I was an avid water skier, single ski. Occasionally when maneuvering through heavy traffic and rough waters, I would fall and be left facing an onslaught of boats while my ride would circle to pick me up. Often uncertain the approaching watercraft would see me, I would frantically swim to my ski and hold it as high as I could, hoping to attract someone's attention within the oncoming vessels, frequently with last second diversions. I was fortunate, however, I know of many others that weren't, with loss of limb and life.

Recently I was watching a boat race up a raging river on a television program. One of the watercraft capsized, leaving the driver and passenger stranded in the middle with other boats approaching. In rough water the survivors were extremely difficult, if not impossible to see.

In cases such as these, it would be much safer if the person in the water had a signaling device which when deployed would raise high above his shoulders to make sighting easier by oncoming traffic.

In making a preliminary search for prior art, two existing patents appeared closest to my invention. For example: U.S. Pat. No. 5,651,711 Samano, disclosed a flag vest which has a flexible mast secured at the back, folded over the shoulder and detachably secured in the front. U.S. Pat. No. 5,893,786 Stevens, discloses a telescoping buoyant pole with a flag.

Although a number of different types of signaling devices were found for the use in water sports, none of the prior art devices are practical to use and wear in various recreational activities. For example: U.S. Pat. No. 5,651,711 Samano, has a mast secured from front to back. The mast would not only hinder movement, but only deploy with a visual impact of approximately 18". U.S. Pat. No. 5,893,786 Stevens, incorporates a telescoping pole which does so each time a person enters the water. This may be fine if a person just floats, however, undoubtedly would interfere in other activities. Again the vertical extension is limited. The raising of a person's arm would attract as much attention.

What is needed is a signaling device which can be stored inconspicuously, attachable to an existing life support vest, and yet when deployed becomes highly visible at a distance even in severe circumstances.

SUMMARY

The present invention will provide a lightweight housing pack that can be easily attached to the back of an existing life support vest, containing a highly visible, flexible mast which can be easily deployed upon demand. At the termination of said mast, a brightly colored flag which will alert oncoming vessels to the presence of a person in the water.

OBJECTS AND ADVANTAGES

Accordingly, several objects and advantages of the present invention are:

(a) to provide a signaling device that insures that the user is capable of being seen from a distance when in a vulnerable, semi-submerged position, without encumbering the individual when said device is not needed.

(b) to provide a product which can be manufactured as an add on kit.

(c) to provide a means of attaching a housing pack to an existing life support vest.

(d) to provide a housing pack which will contain a flexible mast with an attached flag or signaling device.

(e) to provide a housing pack which contains a flexible mast and flag that can be stored conveniently when not in use.

(f) to provide a means of deployment of a mast and flag.

(g) to provide a device that is highly visible when the user is in the water.

(h) to provide a device constructed of lightweight materials, which are durable and easy to manufacture.

(i) to provide a device which will be made of materials readily available, recyclable and at a reasonable cost.

Previous art as mentioned failed to produce visual impact as needed in adverse conditions and they are impractical in recreational uses. Limitation as to vertical extension as well as user's versatility and comfort were neglected with these and other prior art functions. Realize this present invention is more likely to be used with pellucid results.

Further objects and advantages of my invention will become apparent from a consideration of the drawings and ensuing description.

DESCRIPTIVE KEY REFERENCE NUMERALS IN DRAWINGS

| | | | |
|---|---|---|---|
| 10 pack | 40 cord | 70 fasteners | 100 weights |
| 20 mast | 50 sleeve | 80 fastener | 110 sleeve |
| 30 flag | 60 pull ring | 90 flap | 120 closer |

DESCRIPTION OF PREFERRED EMBODIMENT

Figure 1:
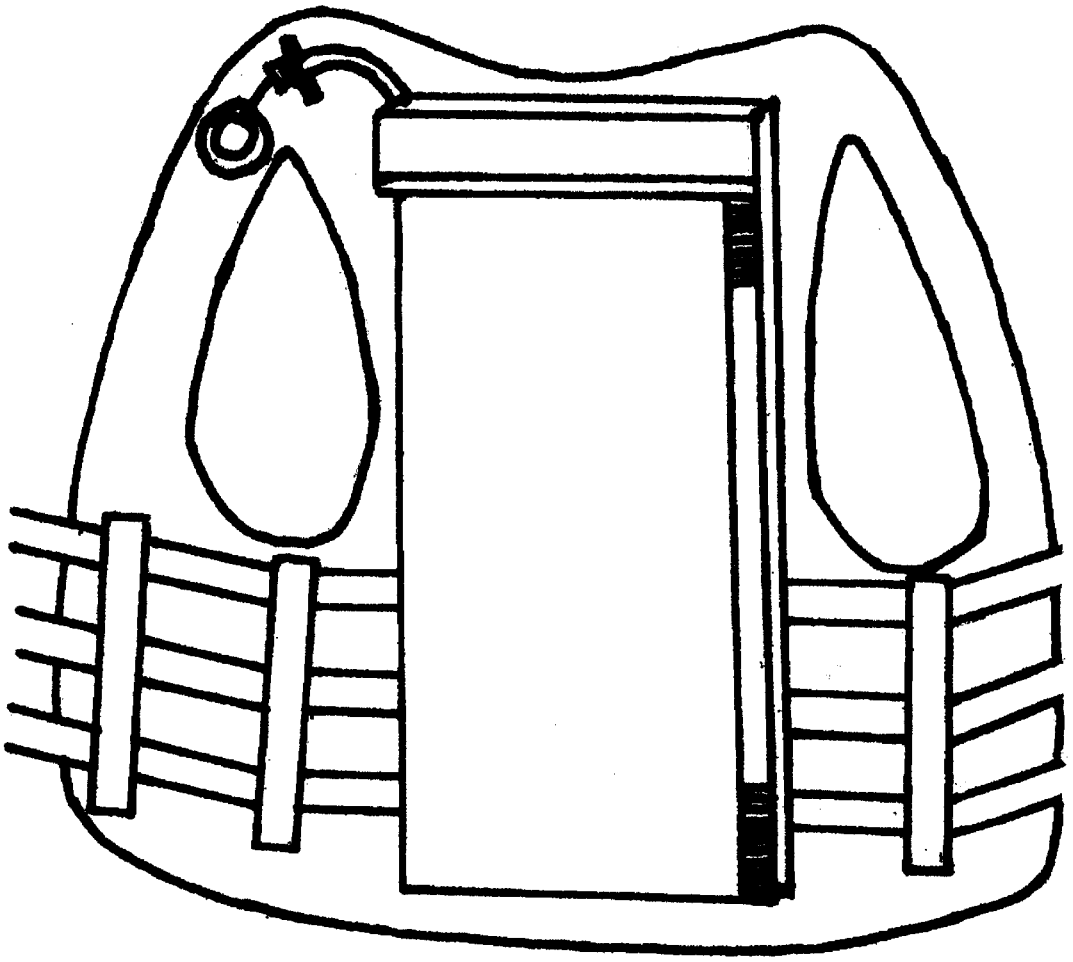
FIG. 1 is a view showing the back of a flotation vest with a housing pack attached.

Referring now to the drawings in detail. FIG. 1 shows a flotation vest from the back side with a housing pack and deployment means attached. FIG. 1 illustrates a housing pack in conjunction with the coupling belts and placement of said pack to the back of a vest. It should be noted that the specific vest shown is merely for illustration purposes, and any style of flotation vest could be used with the present invention.

Figure 2:
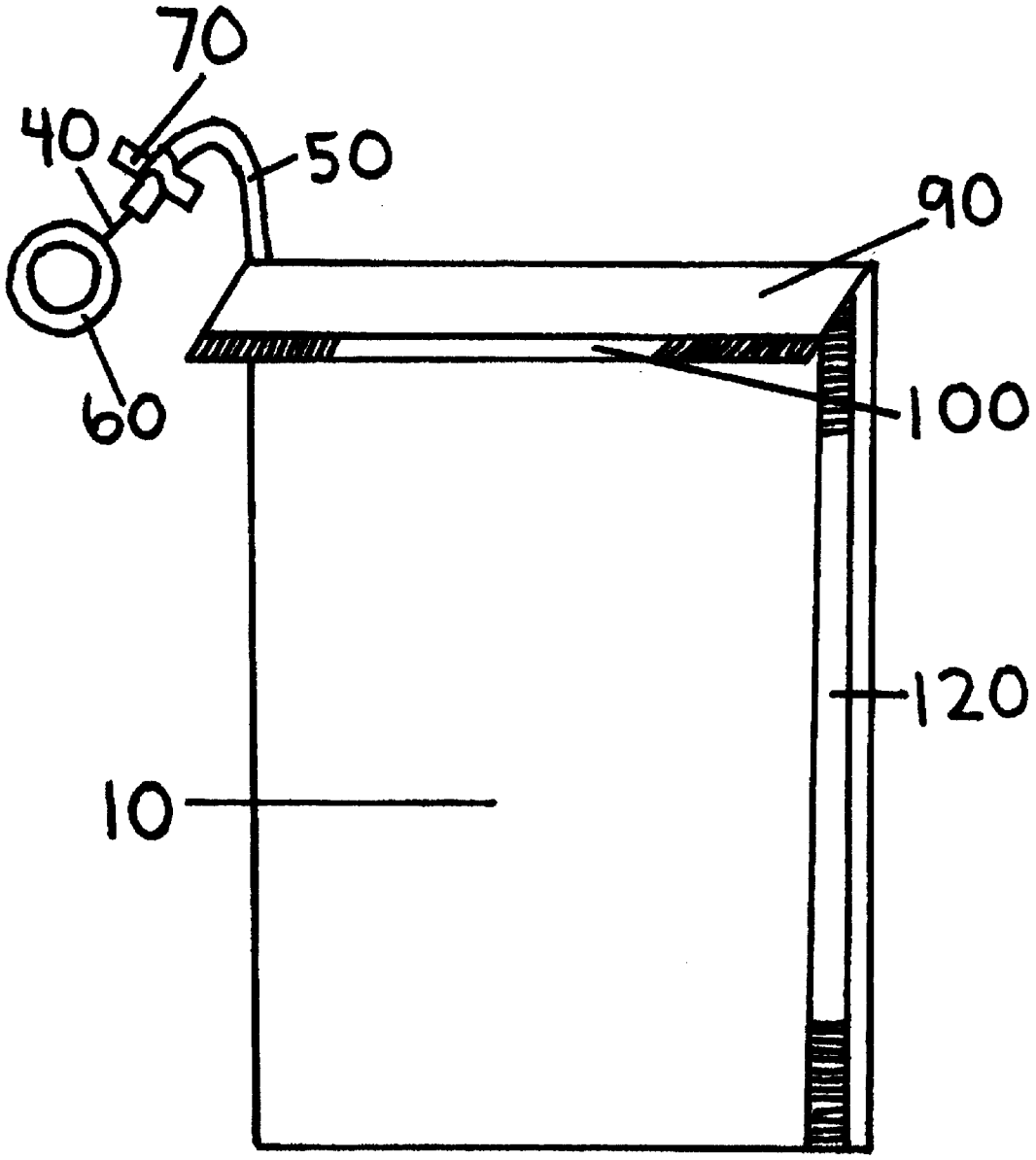
FIG. 2 is a detail view of a housing pack in the closed or secured position.

Referring now to FIG. 2 in detail. The main housing pack 10 includes three basic components. First, a means to deploy comprising, pull ring 60, cord 40, sleeve 50 and fastener 70. Second, flap 90 and weights 100 that are attached to flap 90. Flap 90 will imbricate pack 10. Third, closer 120 will secure the outer flap of pack 10 to the inner body of pack 10. It is envisioned that the main housing pack 10 be constructed of a lightweight durable material, and that it be attractive as well as functional.

Referring to the means to deploy comprising of pull ring 60, pull cord 40, sleeve, 50 and fasteners 70. It is envisioned that pull ring 60 be large, buoyant and strategically placed so that if a person should be unable to pull upon said ring manually, such as an injury related accident, he or she could grasp said ring by mouth and execute the maneuver. It is also envisioned that pull cord 40 be constructed of such material as to allow a smooth transition when pulled through sleeve 50. Sleeve 50 will be small in diameter and secured to the front of a flotation vest by a means of fasteners 70.

Referring now to closer 120. I envision the outer flap of pack 10 to be secured to the inner body of pack 10 by a fastening means closer 120. Closer 120 will be released in an avulsion manner when pull ring 60 and cord 40 are pulled in an opposing direction from the support vest during the process of deployment of mast 20 and flag 30.

Referring now to flap 90. I envision flap 90 to be constructed of a like material such as pack 10 and attached to the inner body of pack 10 at the uppermost position. Flap 90 will imbricate the outer flap of pack 10. Flap 90 will be held in a overlapping position by a means of weights 100. Flap 90 prohibits pack 10 from opening prematurely when a person falls into the water.

Referring now to fasteners 70. Fasteners 70 are to be positioned as to secure sleeve 50 and allow pull cord 40 to move freely within sleeve 50.

Figure 3:
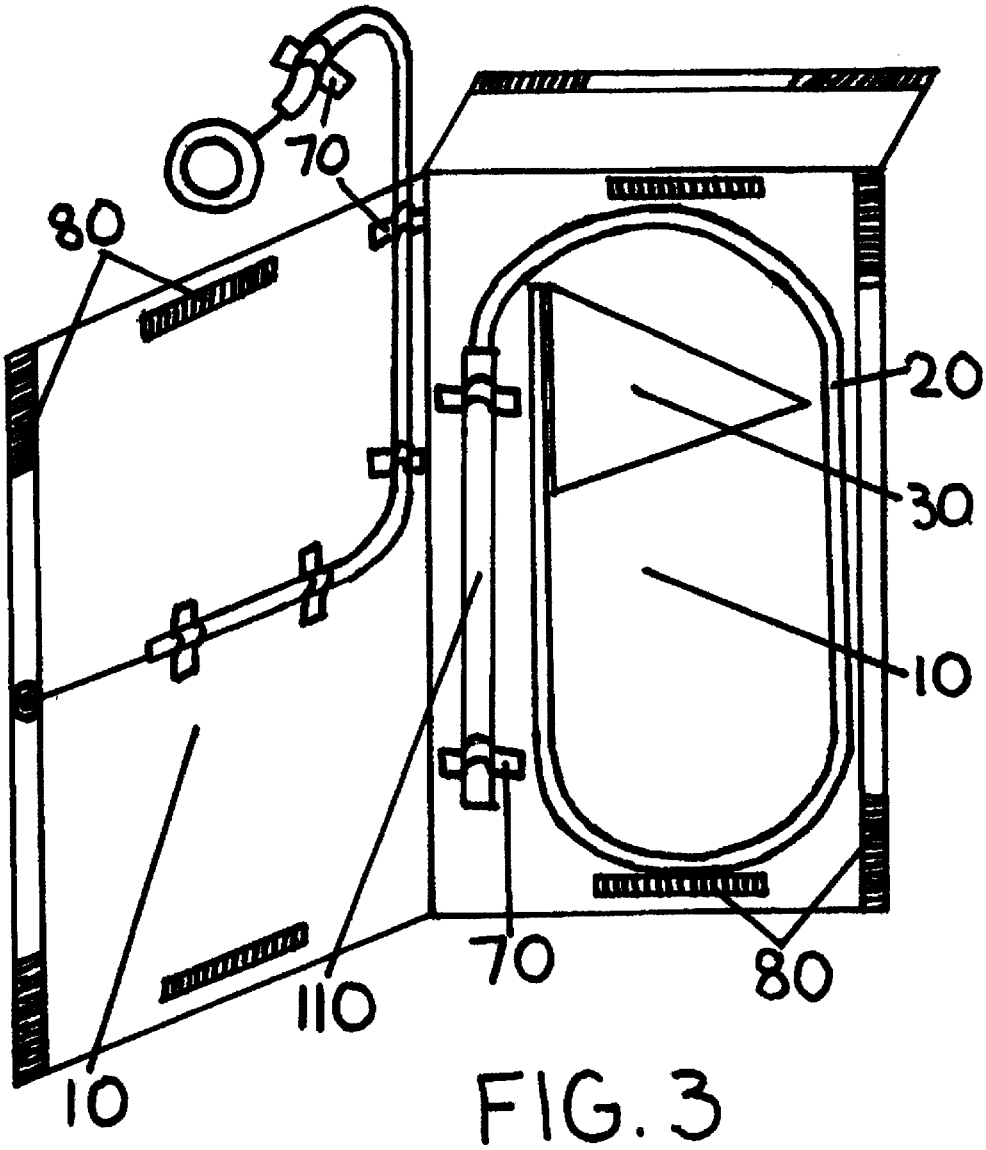
FIG. 3 is a detail view of a housing pack in the open or avulsion position.

Referring now to FIG. 3 in detail. FIG. 3 depicts housing pack 10 in an open position with flexible mast 20 and flag 30 attached as they would be held within the confines of pack 10 prior to deployment.

Referring now to sleeve 110. I envision sleeve 110 to be constructed of a like material such as pack 10. Sleeve 110 will support and house flexible mast 20. Sleeve 110 will be attached to the inner body of pack 10 by a means of fasteners 70.

Referring now to fasteners 80. Fasteners 80 will be attached to pack 10 and positioned accordingly to secure the outer flap of pack 10 to the inner body of pack 10, retaining mast 20 and flag 30 until deployment.

Referring now to mast 20 and flag 30. Mast 20 to be comprised of a flexible material to allow for storage within pack 10 when not use. Flag 30 to be of adequate size and color to be easily seen from a distance.

Figure 4:
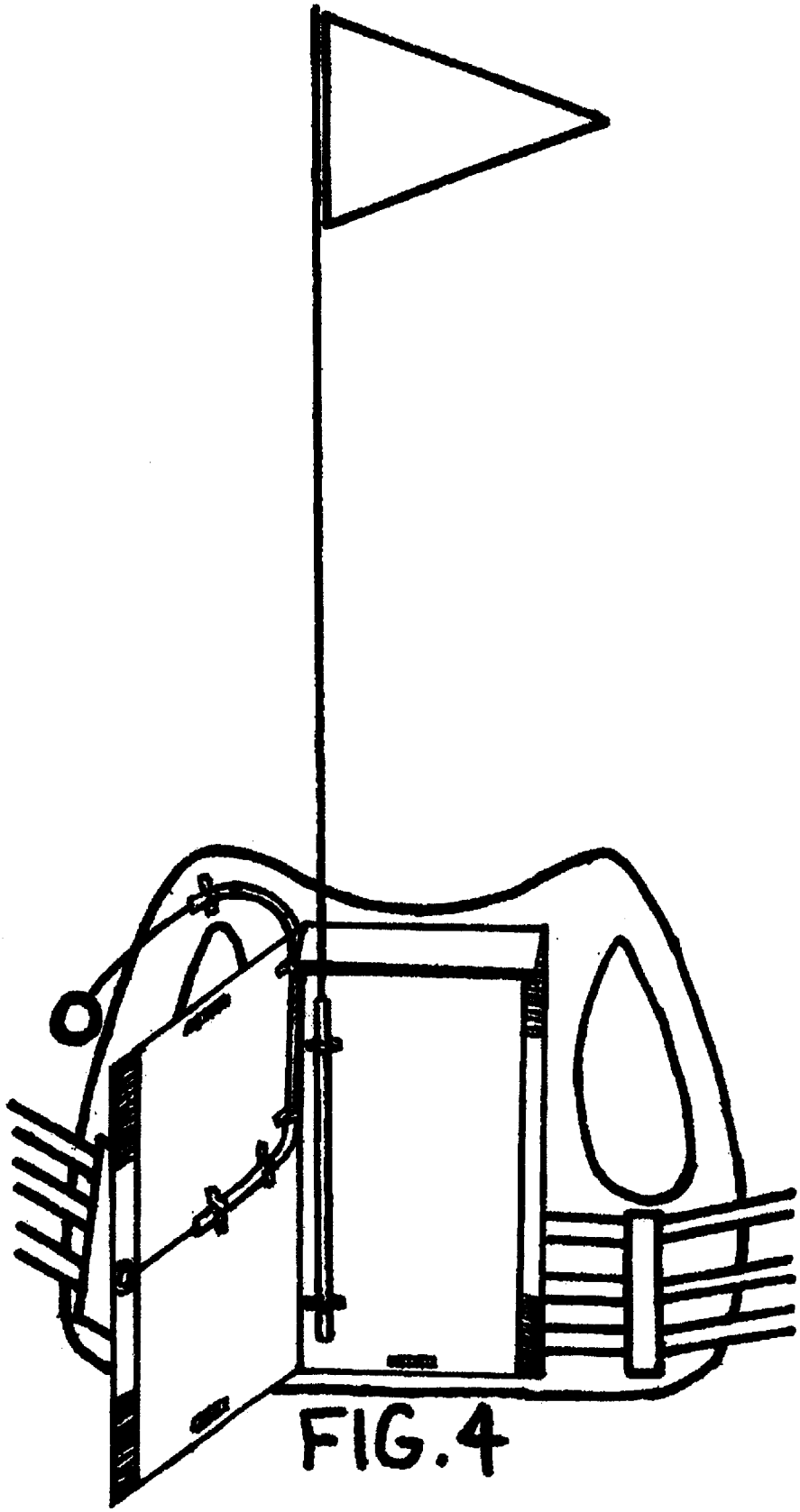
FIG. 4 is a view of the present invention deployed with a flexible mast in an upright position.

Referring now to FIG. 4. FIG. 4 illustrates a housing pack 10 attached to the back of flotation vest with a mast 20 and flag 30 in an upright or deployed position.

Operation of the Preferred Embodiment

Referring to FIG. 2 and FIG. 3 and how to use the present invention. First the housing pack 10 and deployment means sleeve 50 will be attached to a traditional life vest using a fastening means. Should a person decide to activate deployment of mast 20 and flag 30, the person merely pulls on pull ring 60 in an opposing direction from the aforementioned flotation device. Pull ring 60 is attached to pull cord 40 which is housed within sleeve 50. Pull cord 40 terminates at closer 120. The subsequent pulling of pull ring 60 releases closer 120 which is attached to outer flap of pack 10 by a fastening means. Closer 120 is secured to the main body of pack 10 with fasteners 80. Sleeve 50 enables pull cord 40 to travel freely within. This process will allow flexible mast 20 and flag 30 to release and deploy to an upright or vertical position far above the user's shoulders.

Summary

A Flag 'N' A Pak signaling device is not only easy to add on a life vest, it is attractive and functional and will be instrumental in the preservation of life and limb.

Conclusion, Ramifications and Scope of Invention

A Flag 'N' A Pak addition to a person's water sport equipment will not only be an item of safety, but will be visually pleasing, durable, reliable and will be used by individuals of all ages. Our children's safety and well being must always be a primary concern.

I envision the present invention to change in size, as required to fit alternate vest configurations.

The material of a pack may vary to match or color coordinate with existing vests.

I envision a housing pack to be of rectangular shape, however, upon further development an oval or round shape may be necessary to oblige a variety of vest configurations or mast requirements.

I envision the length of the flexible mast may vary due to the development of new mast materials.

I further envision the integral parts of a housing pack to be replaceable elements and readily attainable if said elements are broken or destroyed.

I also envision the present invention to be used in military like situations, such as search and rescue. A signaling device may be added to the end of a mast for transmitting distress signals.

The present invention need not be limited to open and close from right to left. An opposite action will gain the same result with the actuator positioned on the opposing side of the vest.

Lastly, I envision the majority of materials for the present invention to be constructed of recyclable materials.

While my above description contains many specificities, these should not be construed as limitations on the scope of the invention, but rather as an exemplification of one preferred embodiment thereof.

SEQUENCE LISTING

"Non Applicable"

Having described the invention, what is claimed as new is:

1. A water signaling device comprising:

a rectangular closed housing pack for attaching to a back of a flotation vest, said closed housing pack having a thickness, a width, and a height, wherein said thickness is substantially less than said width and said height and wherein said width and height within said closed housing pack defines a plane, said housing pack being capable of attachment to said vest such that said plane is substantially parallel with a plane defined by the surface of the back of the flotation vest, said housing pack including at least one opening flap;

a flag signal including a flexible coilable mast and at least one flag, wherein the flag signal is planarly coiled within said housing pack such that said flag and coilable mast are substantially stored within said plane of said housing pack, said mast including a bottom portion, a middle portion, and a top portion, said middle portion and said top portion being of uniform cross-section, said flag being attached near said top portion;

means for attaching said bottom portion of said mast of said flag signal to said housing pack; and a deployment means which opens said at least one opening flap of said closed housing pack and allows said coilable mask to uncoil such that said mask is substantially straight, said substantially straight mast with said flag extending vertically in a direction substantially coplanar with said plane of said housing pack.

2. The water signaling device of claim 1 wherein at least one of said at least one opening flap is weighted to assist in containing said coilable mast in said plane and within said closed housing pack.

3. The water signaling device of claim 1 wherein said attachment means includes a sleeve on said bottom portion of said mast for attaching said flag signal to said housing pack.

4. The water signaling device of claim 3 wherein the deployment means includes a pull cord and a cord conduit for said pull cord, said pull cord having a distal end with a pull ring remotely located from said housing pack.

5. The water signaling device of claim 4 wherein said pull ring is buoyant and located such that said pull ring is capable of being accessed and pulled by the mouth of a user.

6. The water signaling device of claim 4 wherein said pull cord is constructed of a durable water resistant material.

7. The water signaling device of claim 1 wherein said housing pack is constructed of a durable lightweight water resistant material.

* * * * *